US008403731B2

(12) United States Patent
Hirayama et al.

(10) Patent No.: US 8,403,731 B2
(45) Date of Patent: Mar. 26, 2013

(54) INCLINATION ANGLE ADJUSTING DEVICE AND WORKPIECE ATTACHING DEVICE

(75) Inventors: Haruyuki Hirayama, Yao (JP); Hirohisa Yamada, Yao (JP); Yoshinori Nakanishi, Yao (JP); Tomohiro Okamoto, Yao (JP)

(73) Assignee: Koyo Machine Industries Co., Ltd., Yao-shi (JP)

( * ) Notice: Subject to any disclaimer, the term of this patent is extended or adjusted under 35 U.S.C. 154(b) by 726 days.

(21) Appl. No.: 12/483,700

(22) Filed: Jun. 12, 2009

(65) Prior Publication Data

US 2010/0003907 A1 Jan. 7, 2010

(30) Foreign Application Priority Data

Jul. 2, 2008 (JP) ..... 2008-173233

(51) Int. Cl.
*B24B 41/06* (2012.01)

(52) U.S. Cl. ..... 451/385; 451/387; 451/398; 451/405; 451/413; 451/414

(58) Field of Classification Search ..... 451/387, 451/385, 398, 405, 413, 414
See application file for complete search history.

(56) References Cited

U.S. PATENT DOCUMENTS

| | | | | |
|---|---|---|---|---|
| 5,567,199 | A * | 10/1996 | Huber et al. | 451/398 |
| 5,816,895 | A * | 10/1998 | Honda | 451/41 |
| 6,966,817 | B2 * | 11/2005 | Tang et al. | 451/5 |
| 8,113,918 | B2 * | 2/2012 | Koo et al. | 451/67 |
| 2008/0127888 | A1 * | 6/2008 | Kim et al. | 118/52 |
| 2010/0130105 | A1 * | 5/2010 | Lee | 451/41 |

FOREIGN PATENT DOCUMENTS

| | | |
|---|---|---|
| JP | 02-088167 | 3/1990 |
| JP | 08-215964 | 8/1996 |
| JP | 10-15795 | 1/1998 |

OTHER PUBLICATIONS

First page of Japanese Office Action issued for Japanese Patent Application No. 2008-173233 dated Sep. 28, 2010.

* cited by examiner

*Primary Examiner* — Timothy V Eley
(74) *Attorney, Agent, or Firm* — Kratz, Quintos & Hanson, LLP

(57) ABSTRACT

The present invention facilitates with high accuracy the adjustment of a minute angle degree, and also is capable of sufficiently securing the rigidity of the whole device after the adjustment and provides good operability, accuracy, and rigidity. Provided are a workpiece attaching body having a workpiece attaching surface and a rotating body rotatably supporting the workpiece attaching body. The rotating body has an inclination angle adjusting surface inclined relative to an axis of the rotating body, the workpiece attaching body has opposite to the workpiece attaching surface an inclination angle adjusting surface which is inclined relative to the workpiece attaching surface and which comes in surface contact with the inclination angle adjusting surface of the rotating body, and spherical coupling means is arranged which is for rotatably adjustably coupling the workpiece attaching body and the rotating body about a spherical center on an axis of the rotating body along both inclination angle adjusting surfaces. Thereby, the rotating body and the workpiece attaching body are relatively rotated about the spherical center along both inclination angle adjusting surfaces so as to adjust the inclination angle of the workpiece attaching surface.

11 Claims, 11 Drawing Sheets

INCLINATION ANGLE ADJUSTING DEVICE AND WORKPIECE ATTACHING DEVICE

BACKGROUND OF THE INVENTION

1. Field of the Invention

The present invention relates to an inclination angle adjusting device and a workpiece attaching device.

2. Description of the Related Art

In vertical surface grinders, a workpiece is attached on a workpiece attaching surface on a rotating table, and while the rotating table is rotated, the top surface of the workpiece is surface ground by a grinding wheel rotating about the vertical axis. When a crystal material such as a crystal wafer and a sapphire wafer is surface ground by such a vertical surface grinder, it is necessary to grind by setting the crystal orientation.

For this reason, a method adopted in this case is as follows: on a rotating table rotating about the vertical axis in parallel to a grinding wheel shaft supporting the grinding wheel, a workpiece attaching device provided angularly adjustably with a workpiece attaching section having a workpiece attaching surface on its top surface about the horizontal axis is used; the inclination angle of the work attaching surface is set to the crystal orientation of the workpiece by adjusting the angle degree of the workpiece attaching section relative to the rotating table; and in this state, the workpiece is rotated and ground.

In this type of the workpiece attaching device, as an inclination angle adjusting system for adjusting the inclination angle of the workpiece attaching section, there have been conventionally proposed a seesaw system, a gear drive system, etc.

In the seesaw system, on one end side in a radial direction between a rotating table having a grinding reference surface substantially parallel to a grinding surface of a grinding wheel and a workpiece attaching section having a workpiece attaching surface on its top surface, a pivot section is placed and on the other end side, a height-adjustment screw mechanism is placed, respectively, and the height-adjustment screw mechanism is operated in the up-and-down direction to adjust the inclination angle of the workpiece attaching section about the horizontal axis of the pivot section (Patent Document 1).

In the gear drive system, the workpiece attaching section is pivotally mounted on the rotating table by the horizontal shaft in the radial direction, and also, a servo motor for driving the workpiece attaching section about the horizontal shaft via a worm gear mechanism is arranged on the rotating table, permitting a forward-and-backward drive of the servo motor to adjust the inclination angle of the workpiece attaching section about the horizontal shaft.

[Patent Document 1] Japanese Published Unexamined Patent Application No. H10-15795

In the conventional adjusting systems (either in the seesaw system or in the gear drive system), the workpiece attaching section is swung or pivoted directly about the horizontal axis to adjust the inclination angle, and thus, it is difficult to adjust a minute angle degree.

Further, in the case of the seesaw system, there is a problem that the workpiece attaching section is supported on the rotating table via the pivot section and the height-adjustment screw mechanism, and thus, it is difficult to secure the rigidity of the whole workpiece attaching device, making it impossible to grind the workpiece with high accuracy.

Also in the case of the gear drive system, there is a shortcoming that the workpiece attaching section is supported by the rotating table via the horizontal shaft and the worm gear mechanism, and besides, there is a constant backlash in the worm gear mechanism, making it difficult to secure the rigidity of the whole workpiece attaching device like the seesaw system. Another shortcoming is that the worm gear mechanism and the servo motor are provided on the rotating table rotating about the vertical axis, and thus, the size of the whole workpiece attaching device becomes too large.

In view of the conventional problems, an object of the present invention is to provide an inclination angle adjusting device and workpiece attaching device which is capable of facilitating the adjustment of a minute angle degree with high accuracy and also sufficiently securing the rigidity of the whole device after the adjustment and which can provide good operability, accuracy, and rigidity.

SUMMARY OF THE INVENTION

The present invention is an inclination angle adjusting device including: a support; a movable body coupled to the support; and an inclination angle of an adjustment target section of the movable body opposite to the support being adjustable, wherein the support has an obliquely inclined inclination angle adjusting surface, the movable body has an inclination angle adjusting surface that comes in surface contact with the inclination angle adjusting surface of the support, and the adjustment target section not in parallel to the inclination angle adjusting surface, and coupling means for rotatably adjustably coupling the support and the movable body along the inclination angle adjusting surface is provided.

Another aspect of the present invention is a workpiece attaching device, including: a workpiece attaching body having a workpiece attaching surface; a rotating body rotatably supporting the workpiece attaching body; and an inclination angle of the workpiece attaching surface being adjusted, wherein the rotating body has an inclination angle adjusting surface inclined relative to an axis of the rotating body, the workpiece attaching body has, opposite to the workpiece attaching surface, an inclination angle adjusting surface which is inclined relative to the workpiece attaching surface and which comes in surface contact with the inclination angle adjusting surface of the rotating body, and spherical coupling means for rotatably adjustably coupling the workpiece attaching body and the rotating body about a spherical center on an axis of the rotating body along both inclination angle adjusting surfaces is provided.

The workpiece attaching body may be a rotating table having the workpiece attaching surface and the inclination angle adjusting surface. The workpiece attaching body may include a rotating table having the workpiece attaching surface and an inclination angle adjusting body relatively rotatably interposed between the rotating table and the rotating body, the inclination angle adjusting surface may be arranged in the inclination angle adjusting body, on a facing side of the inclination angle adjusting body and the rotating table, a surface-contact phase angle adjusting surface may be arranged substantially parallel to the workpiece attaching surface and in one of the inclination angle adjusting body and the rotating table, a phase angle adjusting shaft may be arranged which protrudes substantially vertically to an alternate side relative to the phase angle adjusting surface so as to relatively rotatably support the alternate side.

An angle degree formed between the rotating body and the inclination angle adjusting surface and an angle formed between the workpiece attaching surface of the workpiece attaching body and the inclination angle adjusting surface may be substantially identical. A tubular fixed shaft for rotatably supporting the workpiece attaching body from an inner peripheral side via a bearing, and a protrusion shaft protruding inwardly to the fixed shaft from a substantially central side of the workpiece attaching body may be arranged. Between the protrusion shaft and the fixed shaft, the spherical coupling means may be provided.

The spherical coupling means may include a spherical washer section which is interposed between the fixed shaft and the protrusion shaft and which is slidingly fitted around the protrusion shaft in an axial direction, biasing means, fitted around the protrusion shaft, for biasing the workpiece attaching body to a side of the rotating body in the axial direction, and a thrust bearing interposed between the spherical washer section and the biasing means may be provided.

Canceling means for canceling coupling between the rotating body and the workpiece attaching body by a fluid pressure, regulating means for regulating rotation of the workpiece attaching body by being coupled with the workpiece attaching body in a releasably engaged manner, and rotation driving means for rotation-driving the rotating body may be provided. Further, first canceling means for canceling coupling between the rotating body and the inclination angle adjusting body by a fluid pressure, second canceling means for canceling coupling between the inclination angle adjusting body and the rotating table by a fluid pressure, first regulating means for regulating rotation of the inclination angle adjusting body by being coupled with the inclination angle adjusting body in a releasably engaged manner, second regulating means for regulating rotation of the rotating table by being coupled with the rotating table in a releasably engaged manner, and rotation driving means for rotation-driving the rotating body may be provided.

The rotating body rotates about an axis substantially parallel to a grinding wheel shaft of a grinding wheel for surface grinding a workpiece attached on the workpiece attaching surface of the rotating table, the respective inclination angle adjusting surfaces formed on an opposing surface of the rotating body and the inclination angle adjusting body is inclined relative to the axis, and the respective phase angle adjusting surfaces formed on an opposing surface of the rotating table and the inclination angle adjusting body may be substantially parallel to the workpiece attaching surface. On the rotating body, the workpiece attaching body for covering the rotating body from above is arranged, and a seal for sealing a gap between the rotating body and the fixed shaft on a lower side of the bearing may be also arranged.

According to the present invention, there are advantages that it is possible to facilitate the adjustment of a minute angle degree with high accuracy and also to sufficiently secure the rigidity of the whole device after the adjustment, and it can provide good operability, accuracy, and rigidity.

DETAILED DESCRIPTION OF THE PREFERRED EMBODIMENTS

Hereinafter, various embodiments of the present invention will be described in detail based on the drawings. FIG. 1 to FIG. 11 illustrate a first embodiment of the present invention applied to a vertical surface grinder used when modifying and processing the crystal orientation of a crystal material such as a crystal wafer, actually applied to a workpiece attaching device of an inclination angle adjusting system.

Figure 1:
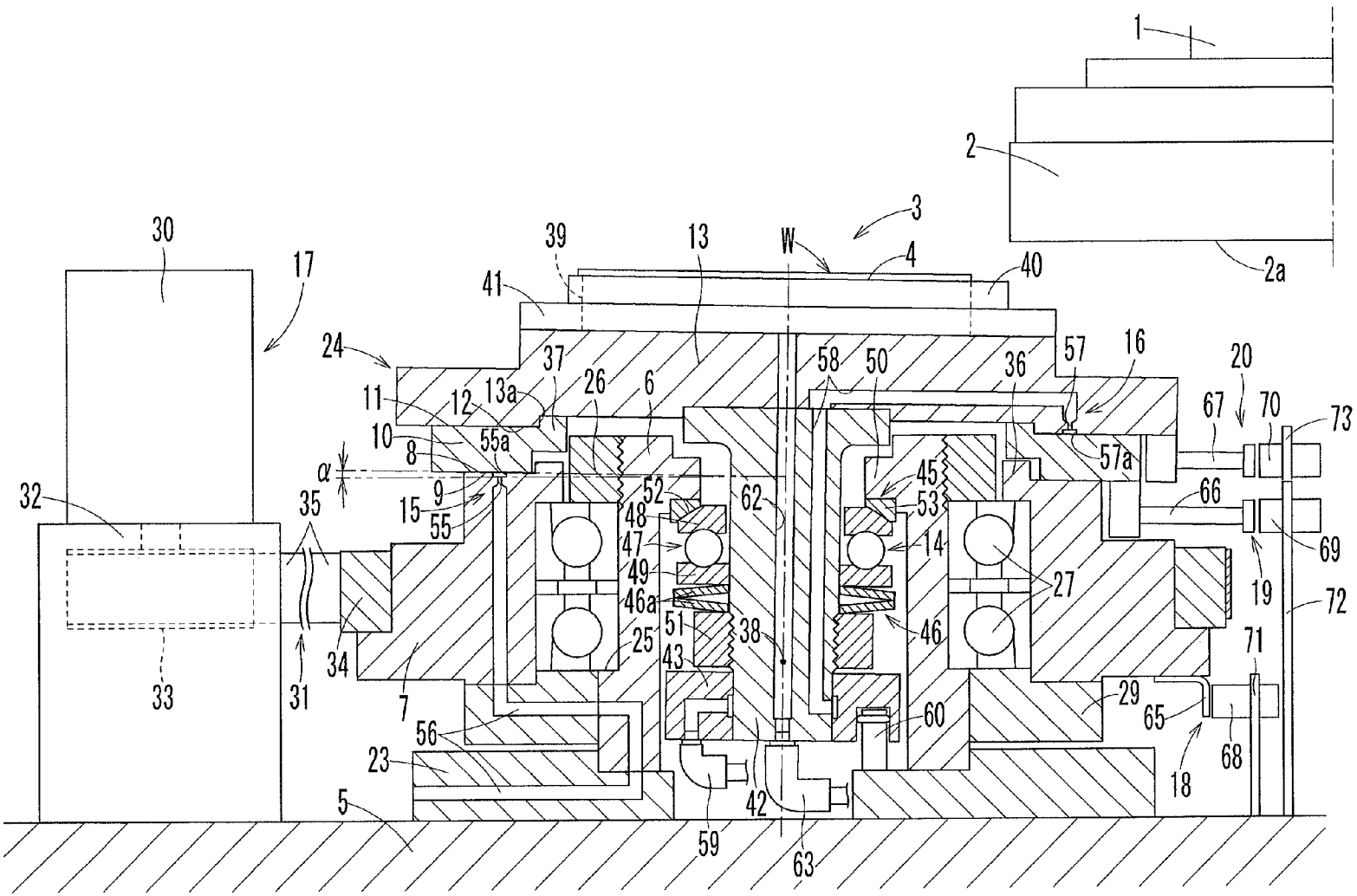
FIG. 1 is a front cross-sectional view of a workpiece attaching device of a vertical surface grinder showing a first embodiment of the present invention.
Figure 2:
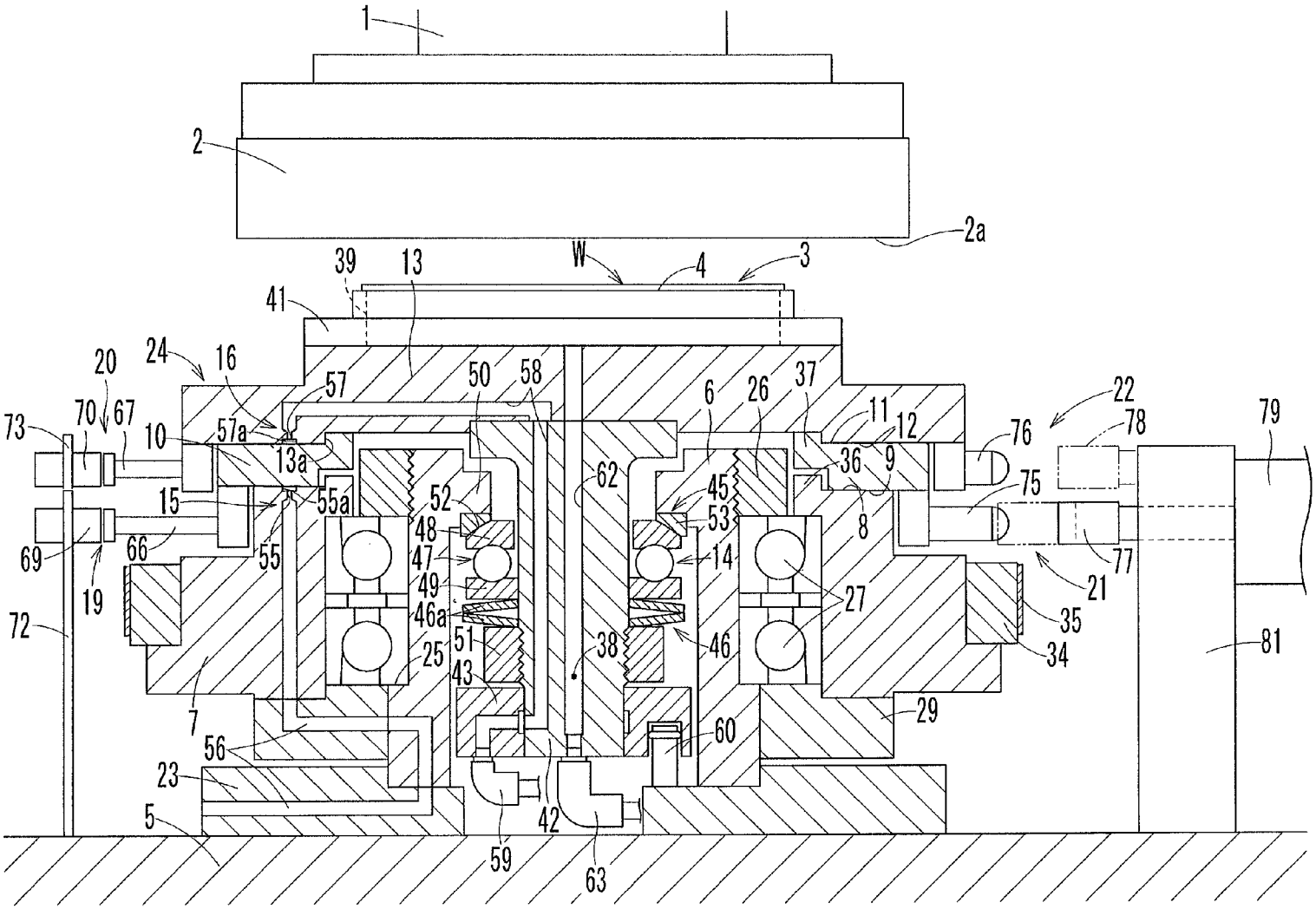
FIG. 2 is a lateral cross-sectional view of the workpiece attaching device.
Figure 3:
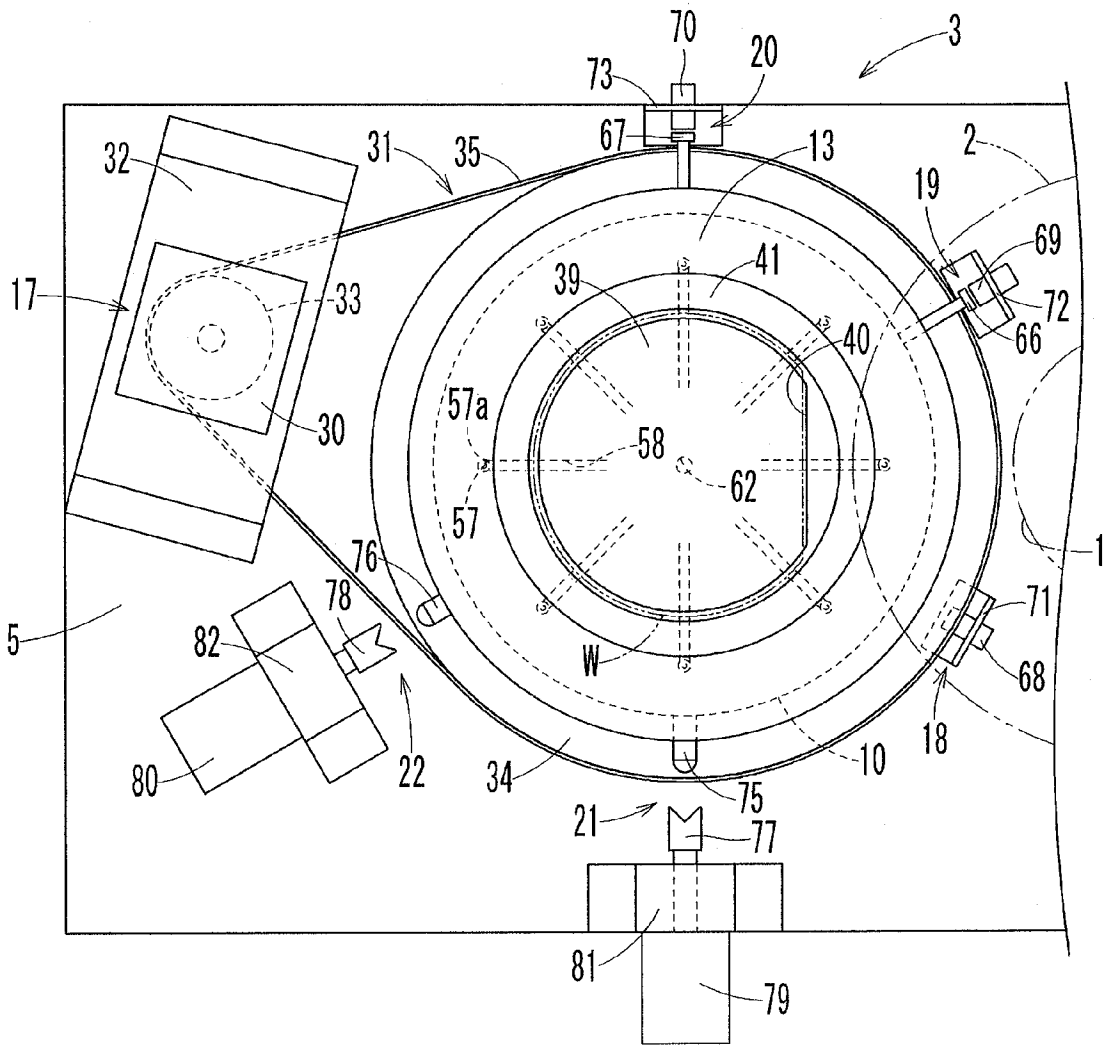
FIG. 3 is a plane view of the workpiece attaching device.

The vertical surface grinder is provided with: a grinding wheel 2 attached at the lower end of a grinding wheel shaft 1; and a workpiece attaching device 3 which is placed below the grinding wheel 2 and which is capable of moving back and forth in left-and-right directions, being a radius direction of the grinding wheel 2, as shown in FIG. 1 to FIG. 3. The vertical surface grinder is configured so as to surface grind (in-feed grind) a workpiece (crystal material) W attached on a workpiece attaching surface 4 of the workpiece attaching device 3 by the grinding wheel 2 at an inclination angle set to a crystal orientation of the workpiece W.

The grinding wheel 2 has a substantially horizontal grinding wheel surface 2*a* on the lower end side, ascends and descends via the grinding wheel shaft 1 in the vertical axis direction by drive of elevating drive means and rotating drive means not shown, and rotates about the vertical axis. The workpiece attaching device 3 can adjust the inclination angle of the workpiece attaching surface 4 and the phase angle of the inclination direction to set the crystal orientation of the workpiece W, and moves back and forth between a grinding position on the lower side of the grinding wheel 2 and a workpiece attaching-and-detaching position on the outside of the grinding wheel 2 by drive of moving drive means not shown.

As shown in FIG. 1 to FIG. 3, the workpiece attaching device 3 is provided with: a movable platform 5 capable of moving between the grinding position and the workpiece attaching-and-detaching position; a fixed shaft 6 in a vertical direction, which is arranged on the movable platform 5 in a standing manner and which is substantially parallel to the grinding wheel shaft 1; a rotating body (support) 7 fitted around the outer periphery of the fixed shaft 6 rotatably about the vertical axis; an inclination angle adjusting body 10 placed relatively rotatably on the rotating body 7 via inclination angle adjusting surfaces 8 and 9; a rotating table 13 placed relatively rotatably on the inclination angle adjusting body 10 via phase angle adjusting surfaces 11 and 12; spherical coupling means 14 for coupling the rotating body 7 and the inclination angle adjusting body 10, and the inclination angle adjusting body 10 and the rotating table 13 about a spherical center 38 on the axis of the rotating body 7 along the inclination angle adjusting surfaces 8 and 9 and the phase angle adjusting surfaces 11 and 12 in a manner to enable respective rotation and adjustment; inclination angle adjusting first canceling means 15 for canceling the coupling between the rotating body 7 and the inclination angle adjusting body 10 by a fluid pressure; phase angle adjusting second canceling means 16 for canceling the coupling between the inclination angle adjusting body 10 and the rotating table 13 by a fluid pressure; rotation driving means 17 for rotation-driving the rotating body 7 about the fixed shaft 6; first detecting means 18 for detecting an original-point position of the rotating body 7; second detecting means 19 for detecting an original-point position of the inclination angle adjusting body 10; third detecting means 20 for detecting an original-point position of the rotating table 13; inclination angle adjusting first regulating means 21 for regulating the rotation of the inclination angle adjusting body 10 by being releasably engaged with the inclination angle adjusting body 10; and phase angle adjusting second regulating means 22 for regulating the rotation of the rotating table 13 by being releasably engaged with the rotating table 13. In addition, in the first embodiment, by the inclination angle adjusting body 10 and the rotating table 13, a workpiece attaching body (movable body) 24 having the workpiece attaching surface 4 is configured.

The fixed shaft 6 is cylindrical, and placed substantially concentrically within the rotating body 7, and has a flange section 23 on its lower end side being fixed by a bolt, etc., on the movable platform 5. A bearing 27 is fitted around the outer periphery of the fixed shaft 6 between a step section 25 on the lower section side and a fixing nut 26 on the upper end side, and via the bearing 27, the rotating body 7 is rotatably supported by the fixed shaft 6 from the inner peripheral side. In addition, one or a plurality of bearings 27, for example, two in the up-and-down direction, are placed, and an angular contact ball bearing, etc., are used.

Figure 4:
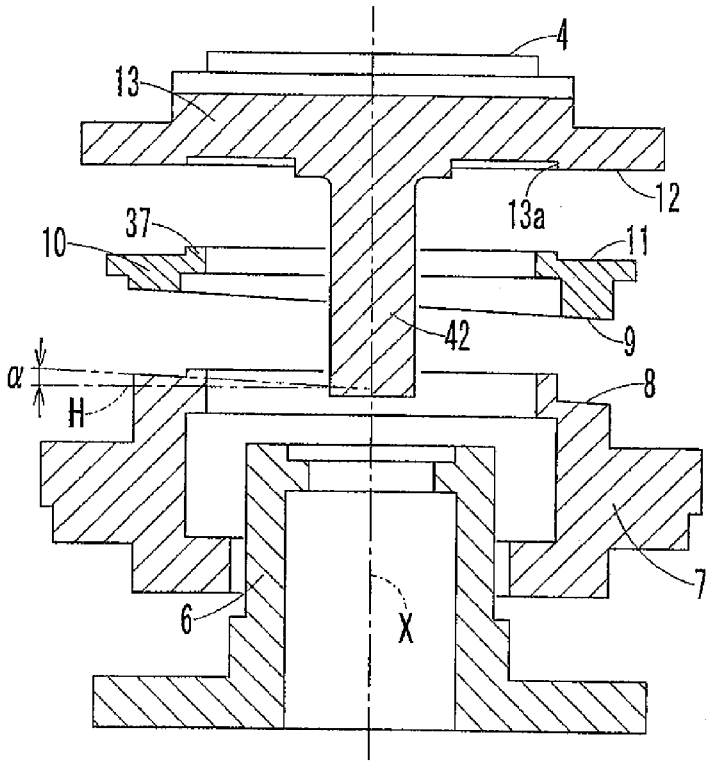
FIG. 4 is a schematic exploded view of the workpiece attaching device.

The rotating body 7 is annular or tubular, the inclination angle adjusting surface 8 is arranged substantially concentrically on its top surface side, and an annular seal 29 that also serves as a bearing cap is fixed substantially concentrically at the lower end by a bolt, etc. The inclination angle adjusting surface 8 is inclined obliquely at an angle degree a relative to a horizontal surface H substantially vertical to an axis X of the fixed shaft 6 (i.e., the rotating body 7) (at an angle degree 90-$\alpha$ relative to the axis X), as shown in FIG. 1 and FIG. 4. The seal 29 is slidingly fitted around the outer periphery of the fixed shaft 6 in the circumferential direction, and seals a gap between the rotating body 7 and the fixed shaft 6 below the bearing 27. In addition, the seal 29 may be fixed at the outer periphery of the fixed shaft 6 to be internally fitted slidingly onto the inner periphery of the rotating body 7.

At its side, the rotating body 7 is driven in a manner to enable normal and reverse rotation via a transmission mechanism 31 by the rotation driving means 17 fixed on the movable platform 5. The rotation driving means 17 is configured by a drive motor 30 such as a servo motor, and the drive motor 30 is fixed on the movable platform 5 via an equipping platform 32. The transmission mechanism 31 is configured by a winding transmission mechanism including: a drive pulley 33 on a side of the drive motor 30; a driven pulley 34 fixed substantially concentrically at the outer periphery of the rotating body 7; and a transmission belt 35, such as a timing belt, wound between these pulleys 33 and 34. In addition, the transmission mechanism 31 may use any mechanism other than a gear transmission mechanism, and other winding transmission mechanisms.

The inclination angle adjusting body 10 is flat and annular. On the bottom surface of the inclination angle adjusting body 10, the inclination angle adjusting surface 9 is arranged substantially concentrically, and on the top surface thereof, the phase angle adjusting surface 11 and a tubular phase angle adjusting shaft 37 protruding above from the inner peripheral side of the phase angle adjusting surface 11 are arranged substantially concentrically. The inclination angle adjusting surface 9 comes in surface contact slidingly in the circumferential direction above the inclination angle adjusting surface 8 of the rotating body 7. The phase angle adjusting surface 11 is substantially parallel to the workpiece attaching surface 4, as shown in FIG. 4, and the angle formed between the phase angle adjusting surface 11 (i.e., the workpiece attaching surface 4) and the inclination angle adjusting surface 9 is substantially identical to the inclination angle degree a of the inclination angle adjusting surface 8 of the rotating body 7. The phase angle adjusting shaft 37 is protruded relative to a side of the rotating table 13 substantially vertical to the phase angle adjusting surface 11, as shown in FIG. 4.

In addition, the upper end of the inclination angle adjusting body 10 is slightly higher than the upper end of the fixed shaft 6, and it may be located substantially equal to the upper end of the fixed shaft 6 or may be slightly lower than that. On the upper end inner peripheral side of the rotating body 7, the inclination angle adjusting body 10 is rotationally moved, at the time of adjusting the inclination angle, relative to the rotating body 7 about the spherical center 38 of the spherical coupling means 14 along the inclination angle adjusting surfaces 8 and 9, and thus, a fitting wall 36 is arranged with predetermined free play in between with the inner periphery of the inclination angle adjusting body 10.

An inclination angle of each inclination angle adjusting surface 8 or 9 and an angle formed between the phase angle adjusting surface 11 and the inclination angle adjusting surface 9 may be ½ (for example, inclination angle degree of 0.3) its maximum inclination angle degree or equal to or more than ½ its maximum inclination angle degree, when an inclination angle $\theta$ of the workpiece attaching surface 4 on the rotating table 13, for example, is adjusted in a stepless manner in a range of from the horizontal (inclination angle degree of 0) to the maximum inclination angle degree (for example, inclination angle degree of 0.6). In addition, in the case of being equal to more than ½ the maximum inclination angle degree, the nearer to ½, the better the resolution.

The rotating table 13 is a circular plate almost sufficiently covering from above an internal mechanism including the inclination angle adjusting body 10 and the fixed shaft 6 on the inner peripheral side, etc. On the bottom surface of the rotating table 13, an inner peripheral hole 13*a*, the phase angle adjusting surface 12 placed on the outside of the inner peripheral hole 13*a*, and a protrusion shaft 42 placed at the center on the inside of the inner peripheral hole 13*a* are arranged substantially concentrically.

The inner peripheral hole 13*a* is substantially parallel to the phase angle adjusting shaft 37, as shown in FIG. 4, and the phase angle adjusting shaft 37 is slidingly fitted to the inner peripheral hole 13*a*. The phase angle adjusting surface 12 is substantially parallel to the workpiece attaching surface 4 and is substantially vertical to the phase angle adjusting shaft 37, as shown in FIG. 4, and slidingly comes in surface contact with the phase angle adjusting surface 11 of the inclination angle adjusting body 10. Therefore, the phase angle adjusting surface 12 of the rotating table 13 comes in surface contact with the phase angle adjusting surface 11 of the inclination angle adjusting body 10, and the rotating table 13 relatively rotates freely about the phase angle adjusting shaft 37 along the phase angle adjusting surfaces 11 and 12.

The protrusion shaft 42 is substantially parallel to the phase angle adjusting shaft 37, as shown in FIG. 4, and protrudes downwardly along the axial direction inwardly to the fixed shaft 6 on the axis of the rotating table 13. In addition, the phase angle adjusting shaft 37 may be arranged on the bottom surface of the rotating table 13 and the inner peripheral hole 13*a* may be arranged in the inclination angle adjusting body 10, respectively.

On the rotating table 13, the workpiece attaching section 39 is arranged substantially concentrically. The workpiece attaching section 39 has on its top surface the workpiece attaching surface 4 parallel to the phase angle adjusting surfaces 11 and 12, and is able to detachably attach the workpiece W on the workpiece attaching surface 4. The workpiece attaching section 39 is of an adsorption type in which the workpiece W on the workpiece attaching surface 4 is adsorbed. The workpiece attaching section 39 is configured by a porous material, having a resistance to wear, such as a ceramics material, and also is detachably fixed on the rotating table 13 via an outer peripheral retaining ring 41 and is designed to adsorb the workpiece W by vacuum drawing of a negative pressure source such as a vacuum pump not shown.

The workpiece attaching section 39 has a positioning section 40 on a side of the workpiece attaching surface 4, and sets a reference section W1 of the workpiece W to the positioning section 40 so as to attach the workpiece W on the workpiece attaching surface 4. The workpiece attaching surface 4 configures an adjustment target section opposite to the inclination angle adjusting surface 9 of the inclination angle adjusting body 10, and is not parallel to the rotating body 7, and the inclination angle adjusting surfaces 8 and 9 of the inclination angle adjusting body 10. In addition, the workpiece attaching surface 4 may not be parallel at least to the inclination angle adjusting surface 8 of the rotating body 7. The workpiece attaching section 39 can be modified as appropriate according to the workpiece W, being a target to be processed, and may be of any other type in addition to the adsorption type.

The protrusion shaft 42 has a length reaching the lower section side of the fixed shaft 6, and has the spherical coupling means 14 being arranged between the protrusion shaft 42 and the fixed shaft 6, and also, a rotating joint 43 is fitted relatively rotatably around the lower side outer periphery of the spherical coupling means 14. In addition, the protrusion shaft 42 may not necessarily be vertical to the workpiece attaching surface 4 and phase angle adjusting surface 12, and may be arranged in a slightly inclined manner.

The spherical coupling means 14 is provided with: a spherical washer section 45 which is interposed between the fixed shaft 6 and the protrusion shaft 42 and which is fitted slidingly around the protrusion shaft 42; biasing means 46, fitted around the protrusion shaft 42, for biasing in the axial direction the rotating table 13 to a side of the rotating body 7 in order to couple the rotating body 7, the inclination angle adjusting body 10, and the rotating table 13 to one another in a manner to disable rotation by the frictional force of the inclination angle adjusting surfaces 8 and 9 and the phase angle adjusting surfaces 11 and 12; and a thrust bearing 47 interposed between the spherical washer section 45 and the biasing means 46.

The thrust bearing 47 serves to rotatably support the protrusion shaft 42 relative to the fixed shaft 6 and is configured by a ball thrust bearing provided with bearing rings 48 and 49 at its upper and lower sections, for example. On the upper side of the thrust bearing 47, the spherical washer section 45 is arranged, and on the lower side, the biasing means 46 is arranged, respectively. These components are interposed between a step section 50 at the upper inner periphery of the fixed shaft 6 and an adjusting nut 51 threaded at the lower outer periphery of the protrusion shaft 42.

The spherical washer section 45 has the spherical center 38 at the intersection between the axis of the fixed shaft 6 (i.e., the rotating body 7) and the axis of the phase angle adjusting shaft 37 (i.e., the protrusion shaft 42), supports the rotating body 7 and the inclination angle adjusting body 10 along the inclination angle adjusting surfaces 8 and 9 at the time of adjusting the inclination angle, and a side of the inclination angle adjusting body 10 including the rotating body 7 and the rotating table 13 along the phase angle adjusting surfaces 11 and 12 at the time of adjusting the phase angle, in a manner to enable relative rotation, respectively, about the spherical center 38, and also supports the rotating table 13 and the inclination angle adjusting body 10 integrally coupled to the rotating body 7 at the time of grinding the workpiece W in a manner to enable rotation about the axis of the fixed shaft 6.

The spherical washer section 45 is provided with a spherical washer 52 formed integrally with the top surface of the bearing ring 48 of the thrust bearing 47, and a spherical saddle 53 placed on the upper side of the spherical washer 52. The spherical saddle 53 is held by the step section 50 at the inner periphery of the fixed shaft 6. In addition, the thrust bearing 47 and the spherical washer section 45 may be separately arranged.

The biasing means 46 is configured by a disc spring 46*a*, and the biasing force is adjustable by the adjusting nut 51. In addition, for the biasing means 46, an elastic body other than the disc spring 46*a*, for example, a coil spring, may be used, and an air cylinder, etc., may also be used.

The first canceling means 15 ejects compressed air (pressure fluid) between the inclination angle adjusting surfaces 8 and 9 from a nozzle 55 to cancel the coupling between the rotating body 7 and the inclination angle adjusting body 10 against the biasing force of the biasing means 46. A plurality of nozzles 55 are arranged at a substantially equal interval in the circumferential direction on a side of the inclination angle adjusting surface 8 of the rotating body 7, and is connected to a compressed air supply source (pressure fluid supply source), not shown, via a passage 56 formed across the rotating body 7, the seal 29, the fixed shaft 6, and the flange section 23.

Like the first canceling means 15, the second canceling means 16 ejects the compressed air (pressure fluid) to between the phase angle adjusting surfaces 11 and 12 from a nozzle 57 to cancel the coupling between the inclination angle adjusting body 10 and the rotating table 13 against the biasing means 46. A plurality of nozzles 57 are arranged at a substantially equal interval in the circumferential direction on a side of the phase angle adjusting surface 12 of the rotating table 13, and are connected to a compressed air supply source (pressure fluid supply source), not shown, via the rotating table 13, a passage 58 formed in the protrusion shaft 42, the rotating joint 43 at the lower end of the protrusion shaft 42, a conduit 59, etc.

In addition, on an opened end side of each nozzle 55 or 57, squared or circular pockets 55*a* and 57*a* having a minute depth are formed, and within the pockets 55*a* and 57*a*, the nozzles 55 and 57 are opened. Thus, when the pockets 55*a* and 57*a* are arranged for each nozzle 55 or 57, the load capacity becomes large, and the air pressure at the time of supplying the compressed air can be lowered. When the pockets 55*a* and 57*a* are arranged, the depth should be as shallow as possible, so that minute vibrations can be prevented. Of course, the pockets 55*a* and 57*a* may be omitted.

The rotating joint 43 can freely slide relatively in the circumferential direction at the outer periphery of the protrusion shaft 42, and is stopped from being rotated by one or a plurality of anti-rotation protrusions 60 protruding from a side of the flange section 23. The anti-rotation protrusion 60 is engaged from below with the rotating joint 43, and both components are able to relatively float via an elastic member, etc., so that the rotating joint 43 can follow the protrusion shaft 42 at the time of rotating the rotating body 7 and at the time of adjusting the inclination angle.

The rotating table 13 and the protrusion shaft 42 are formed with a passage 62 communicating with the bottom surface side of the workpiece attaching section 39. The passage 62 is connected to a negative pressure source not shown via a conduit 63 connected in a manner to enable relative rotation, for example, to the lower end of the protrusion shaft 42. In addition, the conduits 59 and 63 are pulled out, via a cutaway section formed on the bottom surface, etc., of the flange section 23, from the inner peripheral side to the outside.

The first detecting means 18, the second detecting means 19, the third detecting means 20, the first regulating means 21, and the second regulating means 22 are placed radially at a predetermined interval in the circumferential direction on the outer peripheral side of the rotating body 7, the inclination angle adjusting body 10, and the rotating table 13, etc. Each detecting means 18 to 20 is provided with detected bodies 65 to 67 fixed at the outer peripheries of the rotating body 7, the inclination angle adjusting body 10, and the rotating table 13, and detection switches 68 to 70 for detecting these detected bodies 65 to 67. The detection switches 68 to 70 are equipped on the movable platform 5 via support members 71 to 73. In addition, for the detection switches 68 to 70, a non-contact proximity switch, etc., are used, but a contact type switch may also be used. When a servo motor is used for the drive motor 30, the control device side may be stored with coordinate positions of the rotating body 7, the inclination angle adjusting body 10, and the rotating table 13, and thus, the detecting means 18 to 20 may be omitted.

Each regulating means 21 or 22 is provided with: engaging sections 75 and 76 fixed to the outer peripheries of the inclination angle adjusting body 10 and the rotating table 13; engaging tools 77 and 78 releasably engaged with the engaging sections 75 and 76; and engagement driving means 79 and 80 for driving to extend and retract the engaging tools 77 and 78 to and from the engaging sections 75 and 76 in an engaged-and-disengaged direction. The engagement driving means 79 and 80 are fixed via the support members 81 and 82 to the movable platform 5.

The engaging sections 75 and 76 protrude outwardly of the radial direction, and the distal ends are formed spherically. The engagement driving means 79 and 80 are configured by an air cylinder, etc., and its rods penetrate through the support members 81 and 82 to be extendably and retractably arranged in the radial direction. The distal end sides of the engaging tools 77 and 78 are formed in a V-lettered shape from a planar view to correspond to the engaging sections 75 and 76, and the engaging tools 77 and 78 are arranged at the distal ends of rods of the engagement driving means 79 and 80.

Figure 5:
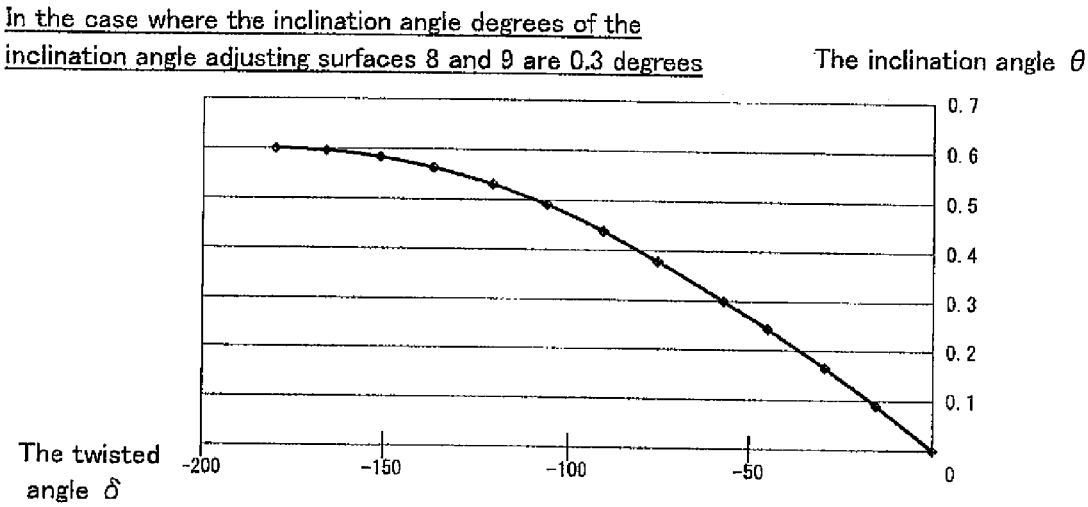
FIG. 5 is a graph showing a relationship between a twisted angle and an inclination angle.
Figure 6:
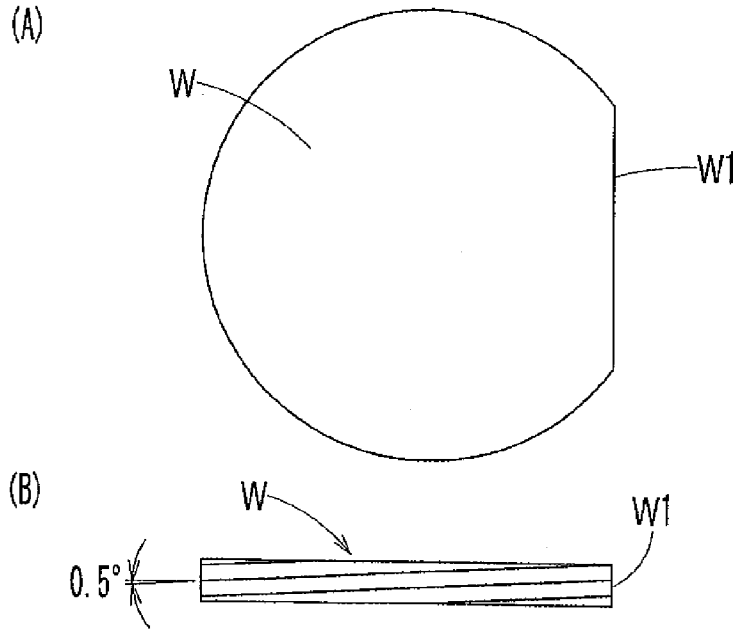
FIG. 6(A) is a plane view of the workpiece.
FIG. 6(B) is its front view.

When the crystal orientation of the workpiece W such as a crystal wafer, etc., is modified and processed by this vertical surface grinder, the following procedures are adopted. For example, in the case where the inclination angle degrees of the inclination angle adjusting surfaces 8 and 9 between the rotating body 7 of the workpiece attaching device 3 and the inclination angle adjusting body 10 are 0.3 degrees, when the inclination angle adjusting body 10 is rotated relatively about the spherical center 38 relative to the rotating body 7 along the inclination angle adjusting surfaces 8 and 9 in a range of 0 to 180 degrees, as shown in FIG. 5, so as to change the twisted angle $\delta$, the inclination angle $\theta$ of the workpiece attaching surface 4 can be adjusted arbitrarily in a range of 0 to 0.6 degrees.

Therefore, as shown in FIGS. 6(A) and 6(B), when the crystal orientation is modified and processed with respect to a workpiece W inclined at the inclination angle of 0.5 degrees relative to a direction in which the crystal orientation forms a right angle to the reference section W1, the workpiece attaching surface 4 is adjusted to an inclination angle $\theta$=0.5 degrees. Then, the inclination direction of the inclination angle $\theta$=0.5 degrees of the workpiece attaching surface 4 is set to an original-point position of the rotating table 13 so as to adjust the phase. In addition, in the first embodiment, for the sake of explanation, the positioning section 40 of the workpiece attaching surface 4 is made to correspond to the original-point position of the rotating table 13.

Subsequently, with reference to FIG. 7(A) and FIG. 7(B) through FIG. 11(A) and FIG. 11(B), the adjusting method is described. In addition, FIG. 7(A) through FIG. 11(A) are schematic plane views of the workpiece attaching device 3 and FIG. 7(B) through FIG. 11(B) are cross-sectional views taken along an a-a line of FIG. 7(A) through FIG. 11(A).

Figure 7:
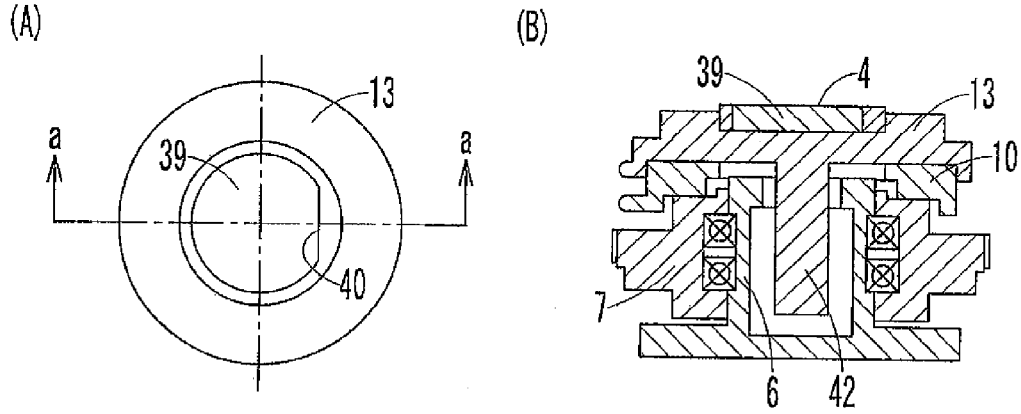
FIG. 7(A) and FIG. 7(B) are operational explanatory diagrams at the time of adjustment, FIG. 7(A) being a schematic plane view and FIG. 7(B) being a cross-sectional view along its a-a line.

In the workpiece attaching device 3, when the rotating body 7, the inclination angle adjusting body 10, and the rotating table 13 are all at the original-point position, the respective axes agree with the identical axes in the vertical direction, as shown in FIG. 7, and the workpiece attaching surface 4 on the rotating table 13 is in a horizontal state, i.e., at the inclination angle of 0 degrees. At this time, in the rotating body 7 and the inclination angle adjusting body 10, the inclination angle adjusting surfaces 8 and 9 come in surface contact, and in the inclination angle adjusting body 10 and the rotating table 13, the phase angle adjusting surfaces 11 and 12 come in surface contact, respectively, resulting in a state coupled so as to disable rotation by the frictional force by the biasing of the disc spring 46*a* of the biasing means 46. The workpiece attaching surface 4 is parallel to the grinding wheel surface 2*a* of the grinding wheel 2, and the positioning section 40 corresponds to the original-point position of the rotating table 13.

Figure 8:
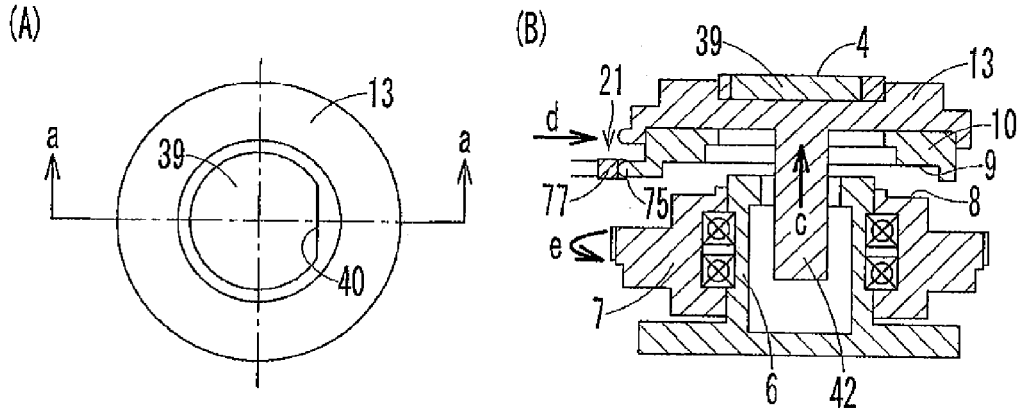
FIG. 8(A) and FIG. 8(B) are operational explanatory diagrams at the time of adjustment, FIG. 8(A) being a schematic plane view and FIG. 9(B) being a cross-sectional view along its a-a line.

At the time of adjusting the inclination angle of the workpiece attaching surface 4, first, from the nozzle 55 of the inclination angle adjusting first canceling means 15, the compressed air is ejected to between the inclination angle adjusting surfaces 8 and 9, and by the resultant static pressure, the inclination angle adjusting body 10 is floated up in an arrow c direction against the disc spring 46*a*, thereby canceling the coupling between the rotating body 7 and the inclination angle adjusting body 10, as shown in FIG. 8. In this way, regardless of the biasing force of the disc spring 46*a* usually applied to the inclination angle adjusting body 10 via the protrusion shaft 42 and the rotating table 13, the coupling between the rotating body 7 and the inclination angle adjusting body 10 can be easily canceled by the first canceling means 15.

Then, simultaneously with or subsequent to canceling the coupling between the rotating body 7 and the inclination angle adjusting body 10, the engaging tool 77 of the first regulating means 21 is moved forward in an arrow d direction so as to be engaged with the engaging section 75 of the inclination angle adjusting body 10, thereby regulating the rotation of the inclination angle adjusting body 10. In this case, because the distal end of the engaging tool 77 is in a V-lettered shape and the engaging section 75 is spherical, if the engaging tool 77 is made to keep on moving forward toward a side of the inclination angle adjusting body 10 by the engagement driving means 79, the engaging tool 77 can be easily and reliably engaged with the engaging section 75.

In the state where the rotation of the inclination angle adjusting body 10 is regulated, the rotating body 7 is driven by the drive motor 30 about the axis via the drive pulley 33, the transmission belt 35, and the driven pulley 34 so as to rotate the rotating body 7 about the fixed shaft 6 by 113 degrees of the inclination angle degree in an arrow e direction (see FIG. 5). Then, since the inclination angle adjusting body 10 is regulated by the first regulating means 21, the rotating body 7 and the inclination angle adjusting body 10 are relatively rotated about the spherical center 38 along the inclination angle adjusting surfaces 8 and 9, and along therewith, the workpiece attaching surface 4 on the rotating table 13 is gradually being inclined from an inclination angle of 0 degrees.

Further, the rotating body 7 and the inclination angle adjusting body 10 relatively rotate along the inclination angle adjusting surfaces 8 and 9. However, between both inclination angle adjusting surfaces 8 and 9, there is an air layer formed of compressed air ejected from the nozzle 55, and via the air layer, the inclination angle adjusting body 10 is floated up. Thus, although the inclination angle adjusting body 10 is rotated and pushed up against the biasing force of the disc spring 46*a* via the inclination angle adjusting surfaces 8 and 9, the rotating body 7 can be lightly and smoothly rotated.

Further, when the inclination angle adjusting body 10 is rotated about the spherical center 38 relative to the rotation of the rotating body 7, the outer peripheral section of the inclination angle adjusting body 10 moves up and down. However, the engaging section 75 is spherical and the distal end of the engaging tool 77 is in a V-lettered shape from a planar view and thus, the first regulating means 21 does not interfere with the movement of the inclination angle adjusting body 10.

The rotation angle (twisted angle δ) of the rotating body 7 can be evaluated by pulse-calculation of the rotation amount of the drive motor 30. When the rotating body 7 is rotated by 113 degrees, the inclination angle θ of the workpiece attaching surface 4 of the rotating table 13 is inclined to 0.5 degrees, as shown in FIG. 5, and thus, the rotation of the rotating body 7 is stopped.

Figure 9:
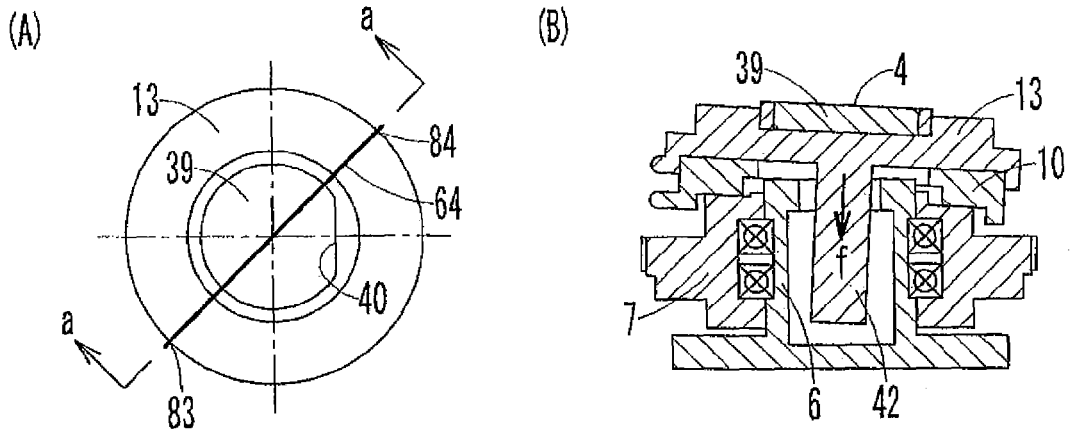
FIG. 9(A) and FIG. 9(B) are operational explanatory diagrams at the time of adjustment, FIG. 9(A) being a schematic plane view and FIG. 9(B) being a cross-sectional view along its a-a line.

When the ejection of the compressed air from the nozzle 55 of the first canceling means 15 is stopped, the inclination angle adjusting body 10 is descended in an arrow f direction by the biasing force of the disc spring 46*a*, as shown in FIG. 9, resulting in the surface contact between the rotating body 7 and the inclination angle adjusting body 10 via the inclination angle adjusting surfaces 8 and 9. Thus, by the mutual frictional force of the inclination angle adjusting surfaces 8 and 9, the rotating body 7 and the inclination angle adjusting body 10 can be easily coupled. Further, the engaging tool 77 is separated from the engaging section 75, and thereby, the regulation of the inclination angle adjusting body 10 by the first regulating means 21 is canceled. As a result, the inclination angle of the workpiece attaching surface 4 reaches 0.5 degrees.

However, in this state, as shown in FIG. 9, there is an inclination top 83 and an inclination bottom 84 of the workpiece attaching surface 4 in the inclination direction 64 of a twisted angle δ=113 degrees, and the rotating table 13 is inclined in a direction of a twisted angle δ=113 degrees. Thus, it is then necessary to set the phase of the inclination direction 64 of the inclination angle θ=0.5 degrees to the original-point position of the rotating table 13.

Figure 10:
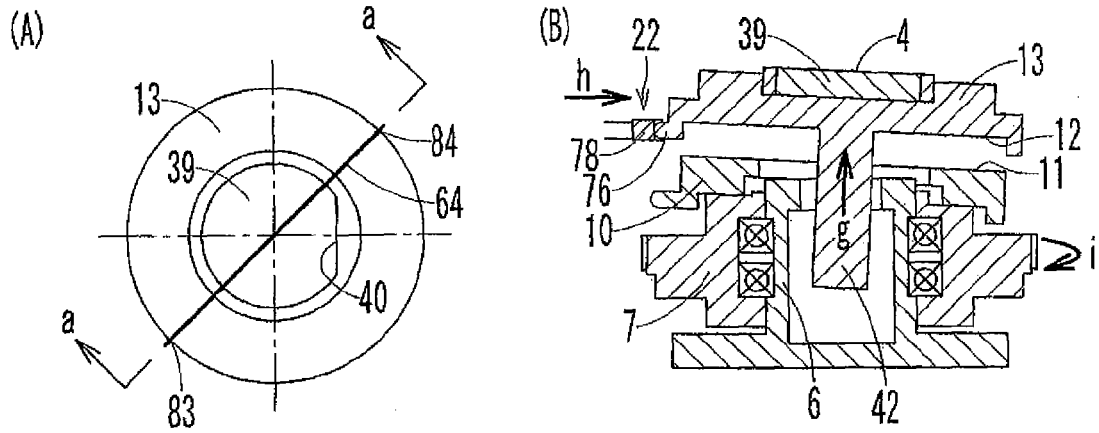
FIG. 10(A) and FIG. 10(B) are operational explanatory diagrams at the time of adjustment, FIG. 10(A) being a schematic plane view and FIG. 10(B) being a cross-sectional view along its a-a line.

At the time of setting the phase, a compressed air of a static pressure is first ejected to between the phase angle adjusting surfaces 11 and 12 from the nozzle 57 of the second canceling means 16, and by the static pressure, the rotating table 13 is floated up in an arrow g direction, as shown in FIG. 10, against the disc spring 46*a*, thereby canceling the coupling between the inclination angle adjusting body 10 and the rotating table 13. Simultaneously therewith or subsequent thereto, the engaging tool 78 of the second regulating means 22 is moved forward in an arrow h direction so as to permit engagement with the engaging section 76 of the rotating table 13, thereby regulating the rotation of the rotating table 13.

In this case also, since the second canceling means 16 is a compressed air ejection type, the coupling between the inclination angle adjusting body 10 and the rotating table 13 can be easily canceled, and also, since the second regulating means 22 is provided with the spherical engaging section 76 and the V-letter shaped engaging tool 78, the engagement between both components is also easy and reliable.

Thereafter, the rotating body 7 is reverse-rotated by the drive motor 30 in an arrow i direction about the fixed shaft 6 via the drive pulley 33, the transmission belt 35, and the driven pulley 34. Then, because the inclination angle adjusting body 10 has been coupled with the rotating body 7 by being pressed by the static pressure of the compressed air between the phase angle adjusting surfaces 11 and 12 and the rotating table 13 has been regulated by the second regulating means 22, the rotating body 7 and the inclination angle adjusting body 10 are integrally rotated about the axis of the fixed shaft 6 passing through the spherical center 38, and the inclination angle adjusting body 10 and the rotating table 13 relatively rotate about the axis of the phase angle adjusting shaft 37 and the protrusion shaft 42 along the phase angle adjusting surfaces 11 and 12. Thereafter, along with the rotation of the inclination angle adjusting body 10, the inclination bottom 84 of the inclination angle adjusting body 10 is moved to a side of the positioning section 40 of the workpiece attaching section 39 on the rotating table 13 at the original-point position.

In this case also, between the phase angle adjusting surfaces 11 and 12 of the inclination angle adjusting body 10 and the rotating table 13, similar to when adjusting the inclination angle, there is an air layer formed of compressed air ejected from the nozzle 57, and via the air layer, the rotating table 13 is floated. Thus, the inclination angle adjusting body 10 and the rotating table 13 can be lightly and smoothly rotated.

Figure 11:
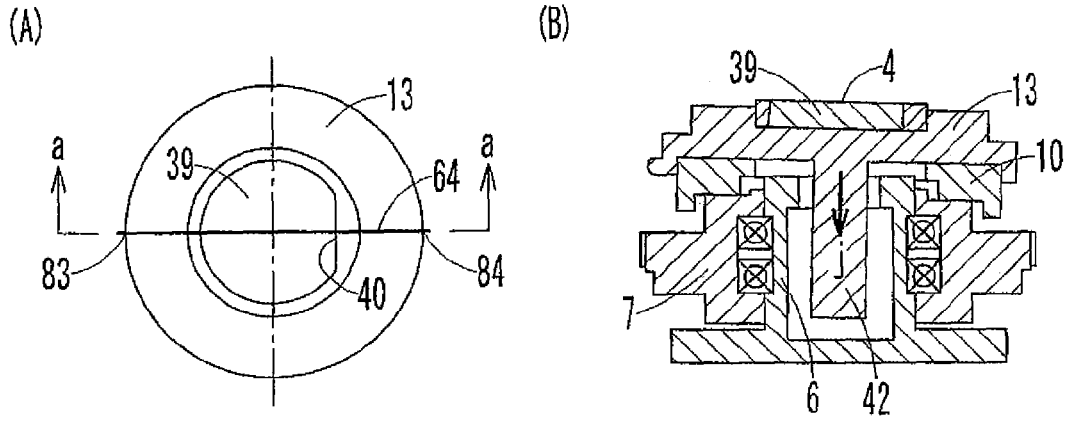
FIG. 11(A) and FIG. 11(B) are operational explanatory diagrams at the time of adjustment, FIG. 11(A) being a schematic plane view and FIG. 11(B) being a cross-sectional view along its a-a line.

The rotation angles of the rotating body 7 and the inclination angle adjusting body 10 are evaluated by pulse-calculation of the rotation amount of the drive motor 30. When the inclination angle adjusting body 10 rotates in an arrow i direction and the inclination direction 64 agrees with a side of the positioning section 40 of the workpiece attaching section 39, the rotating body 7 is stopped as shown in FIG. 11, and also, the ejection of the compressed air from the nozzle 57 of the second canceling means 16 is stopped and the rotating table 13 is descended in an arrow j direction by the biasing force of the disc spring 46*a* so as to be coupled with the inclination angle adjusting body 10, and also, the regulation of the rotating table 13 by the second regulating means 22 is canceled. As a result, the phase of the inclination angle θ=0.5 degrees of the workpiece attaching surface 4 can be set to the direction of the original-point position of the rotating table 13.

In this way, the inclination angle of the workpiece attaching surface 4 is adjusted and the phase of the inclination direction 64 is set. Thereafter, the workpiece W is supplied to the workpiece attaching surface 4 on the workpiece attaching section 39 by being set to the positioning section 40, while integrally rotating by the drive motor 30 the rotating body 7, the inclination angle adjusting body 10, and the rotating table 13 about the axis of the fixed shaft 6 passing through the spherical center 38, the workpiece W is in-feed ground by the grinding wheel 2. Further, when the top and bottom both surfaces of the workpiece W are ground, the crystal orientation can be modified and processed so that the crystal orientation of the workpiece W is substantially parallel to both top and bottom surfaces.

When the canceling means 15 and 16 and the regulating means 21 and 22 are sequentially operated to drive the rotating body 7 by the single drive motor 30, the inclination angle and the phase can be adjusted while rotating each of the rotating body 7 and the inclination angle adjusting body 10, and the inclination angle adjusting body 10 and the rotating table 13. Thus, the operation when adjusting the inclination angle and the phase of the workpiece attaching surface 4 is easy and the automation therefor can be easily promoted. Further, the drive motor 30 for rotation-driving the rotating body 7 can be utilized as such at the time of grinding, and thus, the structural simplification can be possible, which is an advantage.

Moreover, the inclination angle is adjusted by the relative rotation of the rotating body 7 and the inclination angle adjusting body 10 that respectively come in surface contact on the inclination angle adjusting surfaces 8 and 9, and it is possible to greatly allow the relative rotation angle degree between the rotating body 7 and the inclination angle adjusting body 10 relative to the adjusting allowance of the inclination angle, and thus, the resolution is significantly improved and it is possible to with high accuracy adjust the inclination angle without any minute angle degree error.

Moreover, the rotating body 7 and the inclination angle adjusting body 10 come in surface contact on the inclination angle adjusting surfaces 8 and 9, and the inclination angle adjusting body 10 and the rotating table 13 come in surface contact on the phase angle adjusting surfaces 11 and 12, respectively, and the rigidity by the frictional force of the mutual coupled sections of the rotating body 7, the inclination angle adjusting body 10, and the rotating table 13 can be increased. Thus, it is possible to secure a high rigidity easily.

Further, the rotating body 7, the inclination angle adjusting body 10, and the rotating table 13 are on the outside, and in the inside thereof, the fixed shaft 6, the spherical coupling means 14, the bearing 27, the protrusion shaft 42, etc., are accommodated. Thus, good resistance to water and resistance to oil can be provided, and even under a condition in which grinding fluid, cooling oil, etc., are used, sufficient durability can be secured.

The rotating table 13 is arranged with the protrusion shaft 42, and between the protrusion shaft 42 and the fixed shaft 6, the spherical washer section 45, the biasing means 46, and the thrust bearing 47 are interposed, and by the biasing means 46, the rotating table 13 is biased to a side of the rotating body 7 via the protrusion shaft 42. Thus, with the single biasing means 46, the coupling between the rotating body 7 and the inclination angle adjusting body 10, and the coupling between the inclination angle adjusting body 10 and the rotating table 13 are enabled, and thus, the structure of the whole device can be simplified.

The spherical coupling means 14 undergoes the thrust bearing 47 between the spherical washer section 45 and the biasing means 46, and thus, even when the biasing force of the biasing means 46 is sufficiently secured and the mutual frictional force between the rotating body 7 and the inclination angle adjusting body 10, and the inclination angle adjusting body 10 and the rotating table 13 is increased, the rotation of the inclination angle adjusting body 10 about the spherical center 38 can be smoothed.

Besides, the rotating body 6 and the inclination angle adjusting body 10 rotate relatively about the spherical center 38 of the spherical coupling means 14, and the inclination angle adjusting body 10 and the rotating table 13 rotate relatively about the axis of the protrusion shaft 42 and the phase angle adjusting shaft 37 passing through the spherical center 38. Thus, the spherical center 38 of the spherical coupling means 14 can be selected at an arbitrary position on the axis of the rotating body 6, and in consideration of the assembly of the whole device, the spherical coupling means 14 can be designed.

For the workpiece attaching section 39, a porous material is used, and the workpiece attaching section 39 vacuum-adsorbs the workpiece W supplied onto the workpiece attaching surface 4 for fixation. Thus, the attaching and detaching of the workpiece W can be easily performed.

In the first embodiment, the agreement of the positioning section 40 of the workpiece attaching section 39 with the inclination direction of the workpiece attaching surface 4 has been described. However, when the phase of the inclination direction of the crystal orientation differs from the reference section W1 in the circumferential direction, the phase may be adjusted at the workpiece attaching-and-detaching position so that the direction of the crystal orientation of the workpiece W agrees with the inclination direction of the workpiece attaching surface 4.

When the workpiece attaching section 39 does not have the positioning section 40 and the workpiece W is supplied by a loader to the workpiece attaching section 39 at a certain angle degree all the time, the inclination angle is adjusted to a predetermined angle, for example, and thereafter, integrally with the rotating body 7 and the inclination angle adjusting body 10, the rotating table 13 may be rotated and left stopped so that the supplied crystal orientation and the inclination direction of the workpiece attaching surface 4 agree.

Figure 12:
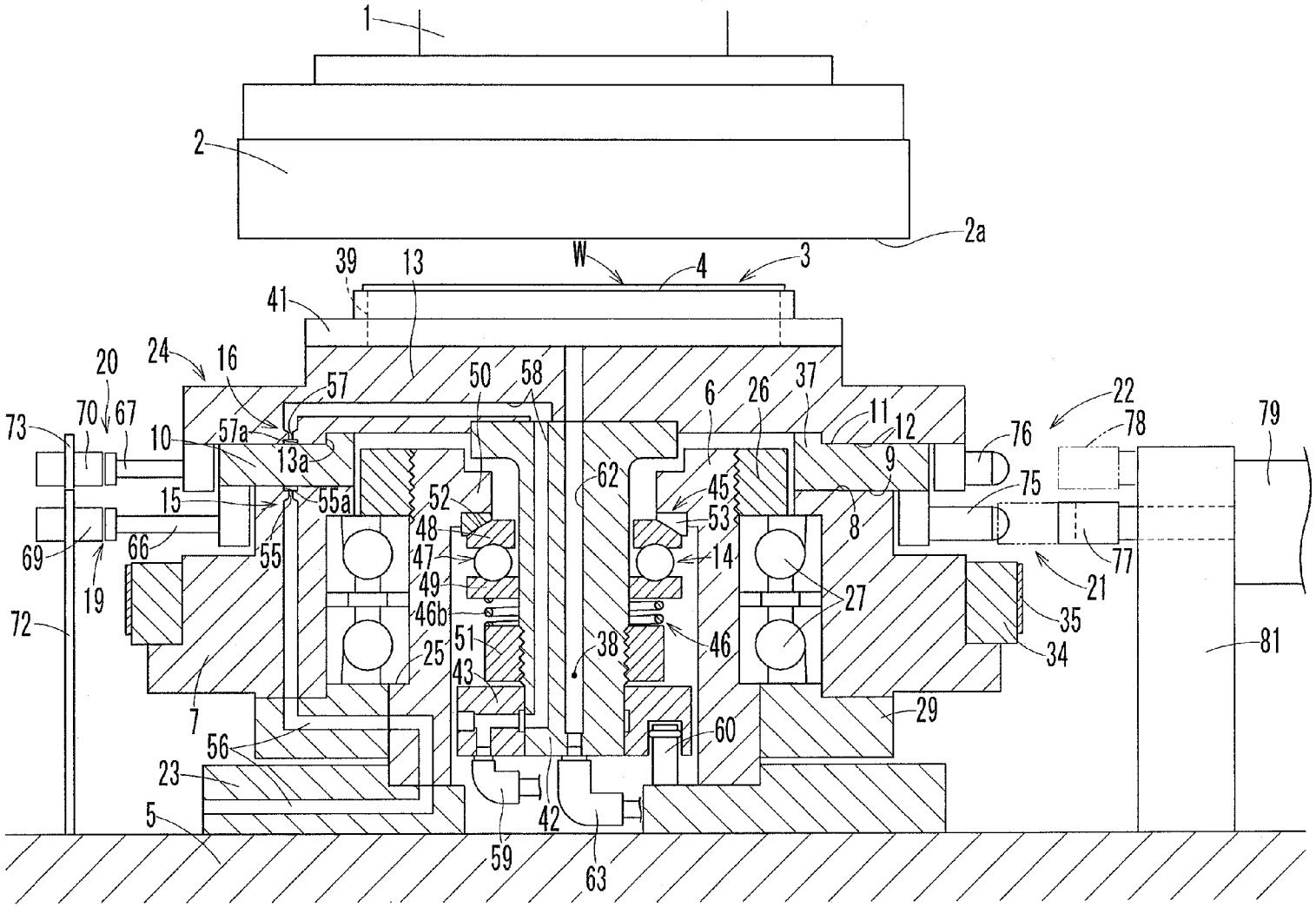
FIG. 12 is a lateral cross-sectional view of a workpiece attaching device showing a second embodiment of the present invention.

FIG. 12 illustrates a second embodiment of the present invention. In the second embodiment, on the top surface of the rotating body 6, there is the inclination angle adjusting surface 8. A section corresponding to the fitting wall 36 of the first embodiment is omitted. At the time of adjusting the inclination angle, the rotating body 6 and the inclination angle adjusting body 10 rotate relatively about the spherical center 38, and thus, the fitting wall 36 of the first embodiment may not be necessary. The biasing means 46 may be a coil spring 46*b*.

Figure 13:
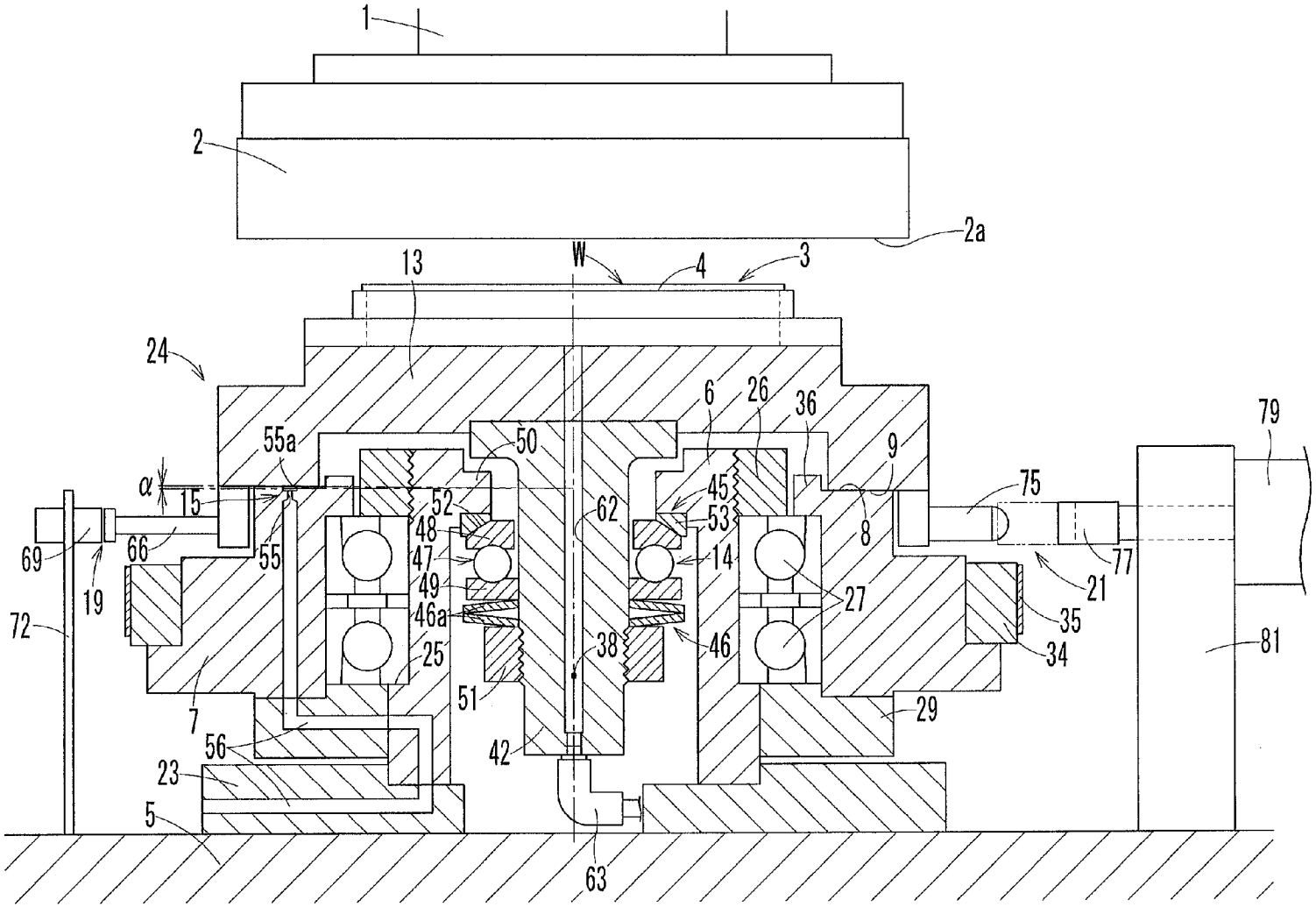
FIG. 13 is a lateral cross-sectional view of a workpiece attaching device showing a third embodiment of the present invention.
Figure 14:
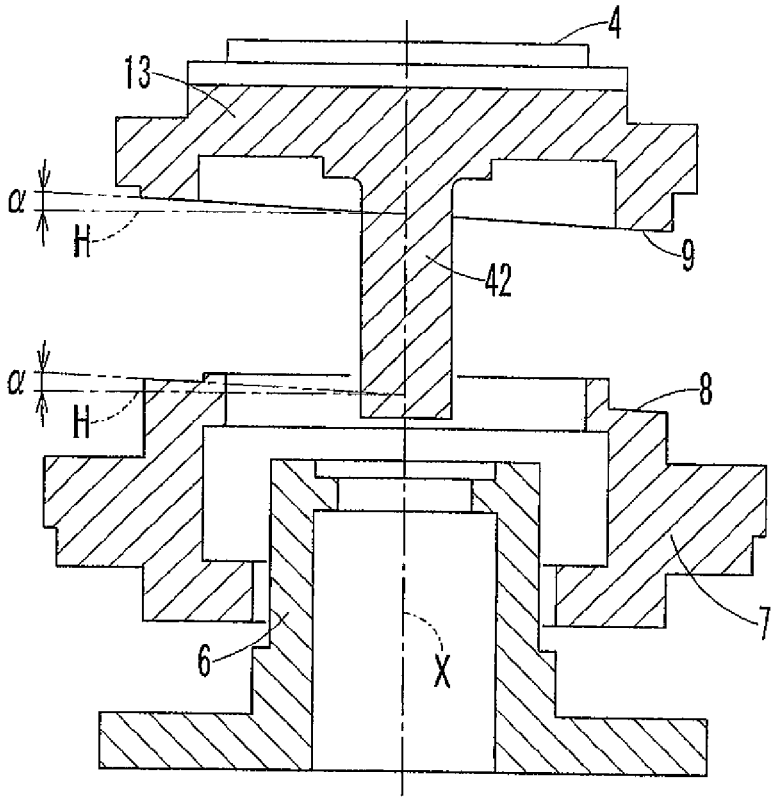
FIG. 14 is a schematic exploded view of the workpiece attaching device.

FIG. 13 and FIG. 14 illustrate a third embodiment of the present invention. In the workpiece attaching device 3 of the third embodiment, the workpiece attaching body 24 is configured by the rotating table 13 that also serves the inclination angle adjusting body 10, and on the bottom surface of the rotating table 13, not only the protrusion shaft 42 but also the inclination angle adjusting surface 9 are arranged. The rotating table 13 includes the inclination angle adjusting surface 9 that slidingly comes in surface contact with the inclination angle adjusting surface 8. In addition, except for the second canceling means 16, the second regulating means 22, the third detecting means 20, and the constituent sections accompanying thereto, the rest of the configuration is the same as that in the first embodiment.

Also in the workpiece attaching device 3 thus configured, when the rotating body 7 and the rotating table 13 are adjusted in rotation angle degree, the inclination angle of the workpiece attaching surface 4 can be arbitrarily adjusted. However, in this case, different from the first embodiment, the phase angle by the rotating table 13 cannot be adjusted. Therefore, when the adjustment of the phase angle is needed, the rotating body 7 and the rotating table 13 may be integrally rotated after the adjustment of the inclination angle and left stopped so that the crystal orientation of the supplied workpiece W and the inclination direction of the workpiece attaching surface 4 agree.

Figure 15:
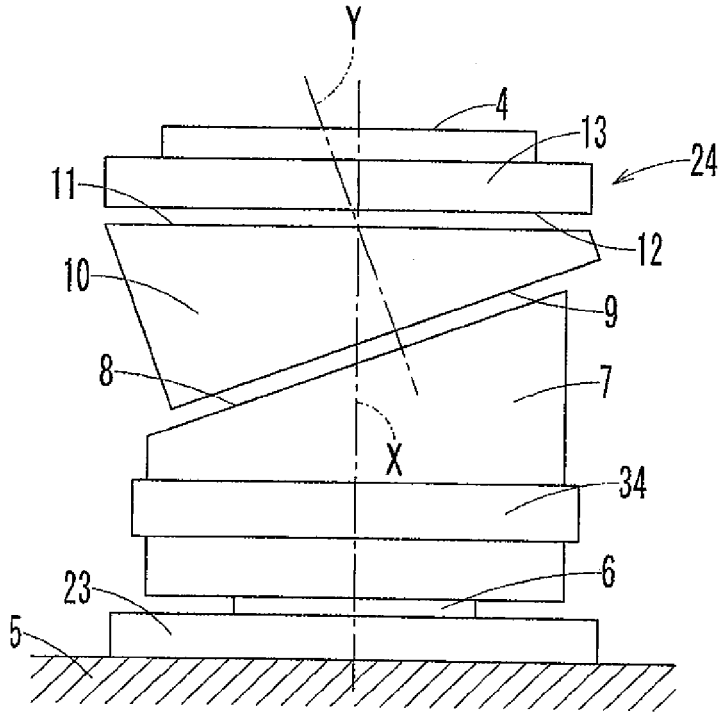
FIG. 15 is a schematic front view of a workpiece attaching device showing a fourth embodiment of the present invention.
Figure 16:
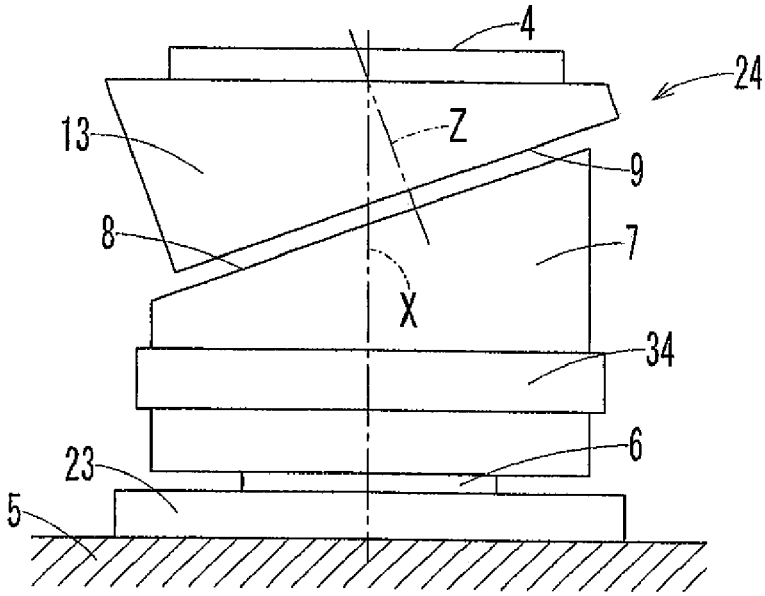
FIG. 16 is a schematic front view of a workpiece attaching device showing a fifth embodiment of the present invention.

FIG. 15 illustrates a fourth embodiment of the present invention, and FIG. 16 illustrates a fifth embodiment of the present invention, respectively. In the first embodiment, the case where the inclination angle adjusting surface 9 is inclined relative to a center line of the inclination angle adjusting body 10 is illustrated, and in the third embodiment, the case where the inclination angle adjusting surface 9 is inclined relative to an axis Z of the rotating table 13 is illustrated. However, in FIG. 15, the inclination angle adjusting surface 9 of the inclination angle adjusting body 10 is substantially vertical to a center line Y, and in FIG. 16, the inclination angle adjusting surface 9 of the rotating table 13 is substantially vertical to a center line Z.

In this way, the inclination angle adjusting surface 9 may not be parallel to the workpiece attaching surface 4 but be inclined obliquely to the workpiece attaching surface 4. Further, the phase angle adjusting surfaces 11 and 12 may be substantially parallel to the workpiece attaching surface 4, and does not need to be substantially vertical to the center line Z of the inclination angle adjusting body 10 and the rotating table 13.

Figure 17:
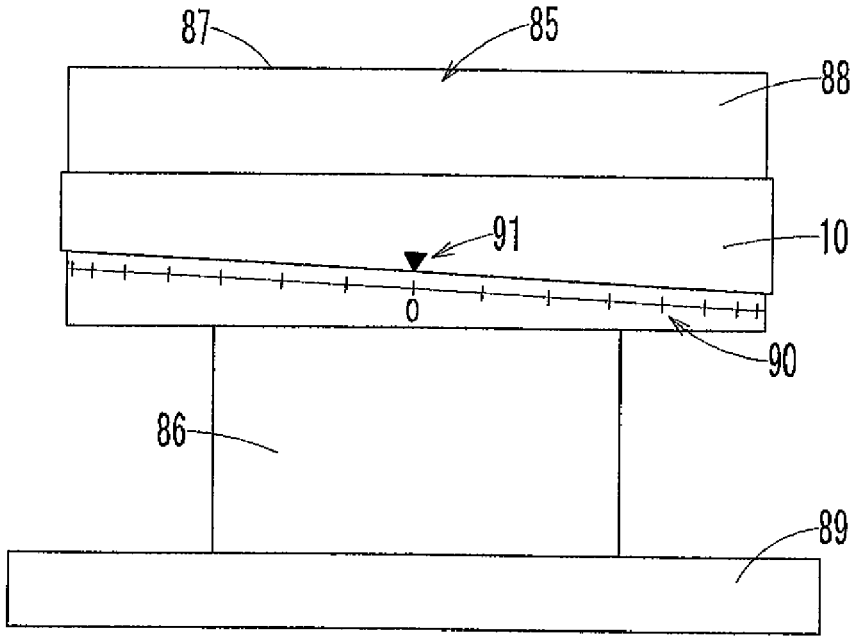
FIG. 17 is a front view of an inclination pedestal device showing a sixth embodiment of the present invention.
Figure 18:
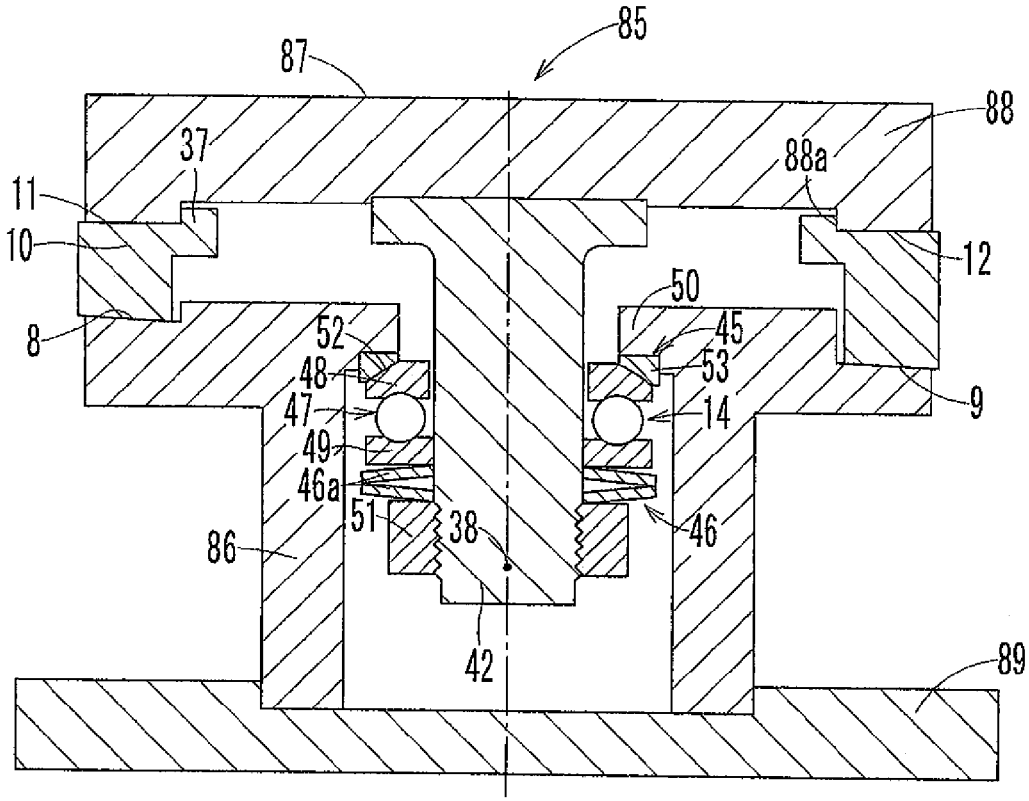
FIG. 18 is its cross-sectional view.

FIG. 17 and FIG. 18 illustrate a sixth embodiment of the present invention. The sixth embodiment is applied to a portable-type inclination pedestal device 85 with an inclination angle adjusting device. The inclination pedestal device 85 serves to support from below a heavy load, etc., by one or a plurality of pieces, and is provided with: a pedestal (support) 86 having an installing section at its lower side; a receiving platform (movable body) 88 having a receiving surface (adjustment target section) 87 on its top surface and being placed on the pedestal 86; and the inclination angle adjusting body 10 interposed to enable rotation between the pedestal 86 and the receiving platform 88. The pedestal 86, the receiving platform 88, and the inclination angle adjusting body 10 are coupled in a manner to enable mutual rotation and adjustment about the spherical center 38 of the spherical coupling means 14.

The pedestal 86 is tubular and has a grounding section 89 at its lower section, and is designed to be set up at the required locations as appropriate. Further, the pedestal 86 has on its top surface the inclination angle adjusting surface 8 obliquely inclined. The inclination angle adjusting body 10 has on its bottom surface the inclination angle adjusting surface 9 that comes in surface contact with the inclination angle adjusting surface 8, and has on its top surface the phase angle adjusting surface 11 and the phase angle adjusting shaft 37 substantially vertical to the phase angle adjusting surface 11. On the bottom surface of the receiving platform 88, there are substantially concentrically provided with: the phase angle adjusting surface 12 substantially parallel to the receiving surface 87 on the top surface and in surface contact with the phase angle adjusting surface 11 of the inclination angle adjusting body 10; an inner peripheral hole 88*a* fitted with the phase angle adjusting shaft 37; and the protrusion shaft 42 protruding substantially vertical to the phase angle adjusting surface 12.

The spherical coupling means 14 is interposed between the step section 50 at the inner-peripheral-side upper end of the pedestal 86 and the adjusting nut 51 at the lower end of the protrusion shaft 42, and similar to FIG. 1, is provided with the spherical washer section 45, the biasing means 46, and the thrust bearing 47. The biasing means 46 has the disc spring 46*a*, etc., and is set to a biasing force sufficient for relatively rotating and operating the pedestal 86, the inclination angle adjusting body 10, and the receiving platform 88 against the frictional force by a manual operation or an operation with a simple tool.

At the outer peripheries of the pedestal 86 and the inclination angle adjusting body 10, an angle degree scale 90 indicating an inclination angle is marked in the circumferential direction at one side and an angle degree instructing section 91 is marked at the other side, respectively. The angle degree scale 90 is arranged within a range of approximately 180 degrees from a horizontal state to a maximum inclination angle degree of the receiving surface 87, or a range of required adjustments. For example, when the angle degree instructing section 91 is set to "0" of the angle degree scale 90, the receiving surface 87 may be horizontal, and when it is set to "0" of the angle degree scale 90, the receiving surface 87 may be at an inclination angle θ.

When the inclination pedestal device 85 is used, at the time of supporting the heavy load and other objects from below, if the inclination angle adjusting body 10 is rotated relative to the pedestal 86 about the spherical center 38 along the inclination angle adjusting surfaces 8 and 9 so as to set the angle degree instructing section 91 to a predetermined angle degree of the angle degree scale 90, the inclination angle of the receiving surface 87 can be arbitrarily adjusted within the maximum adjustment range.

Therefore, it is convenient when there is a need for adjusting the inclination angle on a side of the receiving surface 87 while being set to a site supporting the heavy load, etc. Further, when there is a need for adjusting the phase angle in the inclination direction, the inclination angle adjusting body 10 may be fixed and the receiving platform 88 may be rotated about the spherical center 38, thereby adjusting the phase of the inclination direction of the receiving platform 88.

Thus, each of the embodiments of the present invention has been described in detail, and the present invention is not limited to these embodiments and can be modified in various forms without departing from the scope of the present invention. For example, the rotating body 7 is supported by the fixed shaft 6 via the bearing 27 from its inner peripheral side, however, the rotating body 7 may also be supported from its outer peripheral side by the fixed shaft 6. Further, the rotating body 7 may be arranged at the distal end of the rotating shaft and the rotating shaft may be supported by a bearing box, etc.

In the first embodiment, the protrusion shaft 42 is arranged on the rotating table 13, and the spherical coupling means 14 including the spherical washer section 45, the biasing means 46, and the thrust bearing 47 between the protrusion shaft 42 and the fixed shaft 6 are arranged. However, the protrusion shaft 42 may be arranged on the lower side of the inclination angle adjusting body 10, and between the inclination angle adjusting body 10 and the rotating table 13, the thrust bearing 47 and the biasing means 46 for biasing the rotating table 13 to a side of the inclination angle adjusting body 10 may be separately arranged. That is, the rotating table 13 and the inclination angle adjusting body 10 may not need to be rotated about the spherical center 38, and thus, the biasing means for biasing the inclination angle adjusting body 10 to a side of the rotating body 7 and the biasing means for biasing the rotating table 13 to a side of the inclination angle adjusting body 10 can be separately arranged.

By adopting the spherical coupling means 14, the whole structure can be simplified. The rotating body 7 and the inclination angle adjusting body 10 may be coupled by the first coupling means in a cancelable manner, and the inclination angle adjusting body 10 and the rotating table 13 may be coupled by the second coupling means in a cancelable manner, respectively. Therefore, for the coupling means, other means except for the spherical coupling means 14 may be adopted.

In the first to fifth embodiments, the workpiece attaching device 3 for a vertical surface grinder is illustrated, and this workpiece attaching device 3 can be utilized for a horizontal surface grinder by rotatably placing the rotating body 7, the rotating table 13, etc., about the horizontal shaft. Further, the workpiece attaching device 3 can also be applied to a mechanical processing device for mechanically processing the workpiece W by rotating it about the axis of the rotating body 7. Therefore, the workpiece attaching device 3 is not limited to the use for a surface grinder.

The workpiece attaching section 39 will become convenient if it is of the adsorption type when the workpiece W has a surface to be adsorbed, however, when a workpiece W without the surface to be absorbed is a target, any other workpiece attaching section 39 not of the adsorption type may be used. Therefore, the workpiece attaching section 39 may be changed as appropriate according to the workpiece W that is a target.

When the inclination angle of an adjustment target section is adjusted between a state where the adjustment target section such as the workpiece attaching surface 4 and the receiving surface 87 is substantially vertical to the axis of the rotating body 7 and a state where it is inclined at the maximum angle degree, the angle formed between the adjustment target section and the inclination angle adjusting surface 9 needs to be substantially identical to the angle degree of the inclination angle adjusting surface 8 of the rotating body 7. However, when the inclination angle of the adjustment target section is adjusted between the minimum inclination angle degree and the maximum inclination angle degree, the angle formed between the adjustment target section and the inclination angle adjusting surface 9 does not need to be substantially identical to the angle degree of the inclination angle adjusting surface 8 of the rotating body 7.

Each of the canceling means 15 and 16 has advantages in that when the coupling is canceled by ejecting the compressed air between the upper and lower inclination angle adjusting surfaces 8 and 9 and between the phase angle adjusting surfaces 11 and 12, the structure becomes very simple, and further, the subsequent relative rotation between the rotating body 7 and the inclination angle adjusting body 10, and that between the inclination angle adjusting body 10 and the rotating table 13 can be smooth. As long as the mutual relative pivoting can be permitted, the canceling can be effected by utilizing other mechanical supports.

A peripheral groove may be formed on both or one of the mutually facing inclination angle adjusting surfaces 8 and 9, and phase angle adjusting surfaces 11 and 12, and from the nozzles 55 and 57, the pressure fluid may be ejected to the peripheral groove. The pressure fluid ejected from the nozzles 55 and 57 is generally compressed air, but other gases may be utilized, and other liquids such as oil may also be utilized.

Each of the regulating means 21 and 22 may be any means which is coupled with inclination angle adjusting body 10 and rotating table 13 in a releasably engaged manner so as to regulate the rotation thereof, and for example, the engaging tool may be so placed that it is engaged and disengaged from below into the up-and-down direction.

In the various embodiments, as the inclination angle adjusting device, the workpiece attaching device 3 and the inclination pedestal device 85 are illustrated, and as its supports, the rotating body 7 and the pedestal 86 are depicted, as the movable body, the rotating table 13 and the receiving platform 88, and as the adjustment target section, the workpiece attaching surface 4 and the receiving surface 87, respectively. The inclination angle adjusting device is not limited to the workpiece attaching device 3 and the inclination pedestal device 85, and in addition to these, it can also be widely applicable to various types of mechanical devices.

In addition, substantially horizontal means horizontal, substantially vertical means vertical, substantially parallel means parallel, substantially concentric means concentric, and substantially identical means identical, respectively.

What is claimed is:

1. An inclination angle adjusting device, comprising:

a support;

a movable body coupled to the support; and an adjustment target section opposite the support having an adjustable inclination angle, wherein the support has an obliquely inclined inclination angle adjusting surface, the movable body has an inclination angle adjusting surface that comes in surface contact with the inclination angle adjusting surface of the support and the adjustment target section not in parallel to the inclination angle adjusting surface of the support, and coupling means for rotatably adjustably coupling the support and the movable body along the inclination angle adjusting surface is provided.

2. A workpiece attaching device, comprising:

a workpiece attaching body having a workpiece attaching surface;

a rotating body rotatably supporting the workpiece attaching body; and an inclination angle of the workpiece attaching surface being adjustable, wherein the rotating body has an inclination angle adjusting surface inclined relative to an axis of the rotating body, the workpiece attaching body has, opposite to the workpiece attaching surface, an inclination angle adjusting surface which is inclined relative to the workpiece attaching surface and which comes in surface contact with the inclination angle adjusting surface of the rotating body, and spherical coupling means for rotatably adjustably coupling the workpiece attaching body and the rotating body about a spherical center on an axis of the rotating body along both inclination angle adjusting surfaces is provided.

3. The workpiece attaching device according to claim 2, wherein the workpiece attaching body is a rotating table having the workpiece attaching surface and the inclination angle adjusting surface of the workpiece attaching body.

4. The workpiece attaching device according to claim 2, wherein the workpiece attaching body includes a rotating table having the workpiece attaching surface and an inclination angle adjusting body relatively rotatably interposed between the rotating table and the rotating body, the inclination angle adjusting surface of the workpiece attaching body is arranged in the inclination angle adjusting body, on each surface of the inclination angle adjusting body and the rotating table facing each other, a surface-contact phase angle adjusting surface is arranged substantially parallel to the workpiece attaching surface, and in one of the inclination angle adjusting body and the rotating table, a phase angle adjusting shaft is arranged which protrudes substantially vertically to the other of the inclination angle adjusting body and the rotating table relative to the phase angle adjusting surface so as to relatively rotatably support the other.

5. The workpiece attaching device according to any one of claims 2 to 4, wherein an angle degree formed between the rotating body and the inclination angle adjusting surface of the rotating body and an angle formed between the workpiece attaching surface of the workpiece attaching body and the inclination angle adjusting surface of the workpiece attaching body are substantially identical.

6. The workpiece attaching device according to any one of claims 2 to 4, further comprising:

a tubular fixed shaft for rotatably supporting from an inner peripheral side the workpiece attaching body via a bearing; and a protrusion shaft protruding inwardly to the fixed shaft from a substantially central side of the workpiece attaching body, wherein between the protrusion shaft and the fixed shaft, the spherical coupling means is provided.

7. The workpiece attaching device according to claim 6, wherein the spherical coupling means comprises:

a spherical washer section which is interposed between the fixed shaft and the protrusion shaft and which is slidingly fitted around the protrusion shaft in an axial direction;

biasing means, fitted around the protrusion shaft, for biasing the workpiece attaching body to a side of the rotating body in the axial direction; and a thrust bearing interposed between the spherical washer section and the biasing means.

8. The workpiece attaching device according to claim 3, further comprising:

canceling means for canceling coupling between the rotating body and the workpiece attaching body by a fluid pressure;

regulating means for regulating rotation of the workpiece attaching body by being coupled with the workpiece attaching body in a releasably engaged manner; and rotation driving means for rotation-driving the rotating body.

9. The workpiece attaching device according to claim 4, further comprising:

first canceling means for canceling coupling between the rotating body and the inclination angle adjusting body by a fluid pressure;

second canceling means for canceling coupling between the inclination angle adjusting body and the rotating table by a fluid pressure;

first regulating means for regulating rotation of the inclination angle adjusting body by being coupled with the inclination angle adjusting body in a releasably engaged manner;

second regulating means for regulating rotation of the rotating table by being coupled with the rotating table in a releasably engaged manner; and rotation driving means for rotation-driving the rotating body.

10. The workpiece attaching device according to claim wherein the rotating body rotates about an axis substantially parallel to a grinding wheel shaft of a grinding wheel for surface grinding a workpiece attached on the workpiece attaching surface of the rotating table, the inclination angle adjusting surfaces formed on each surface of the rotating body and the inclination angle adjusting body facing each other are inclined relative to the axis, and the phase angle adjusting surfaces formed on each surface of the rotating table and the inclination angle adjusting body facing each other are substantially parallel to the workpiece attaching surface.

11. The workpiece attaching device according to claim 6, wherein on the rotating body, the workpiece attaching body for covering the rotating body from above is arranged, and a seal for sealing a gap between the rotating body and the fixed shaft on a lower side of the bearing is arranged.

* * * * *